US006276332B1

(12) United States Patent
Storhok et al.

(10) Patent No.: US 6,276,332 B1
(45) Date of Patent: Aug. 21, 2001

(54) ELECTRONIC AIRFLOW CONTROL

(75) Inventors: Eric Matthew Storhok, Ann Arbor; Kelly M Arbanas, Farmington Hills, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/433,911

(22) Filed: Nov. 3, 1999

(51) Int. Cl.[7] ..... F02D 9/02
(52) U.S. Cl. ..... 123/397; 123/361; 123/399
(58) Field of Search ..... 123/399, 361, 123/397

(56) References Cited

U.S. PATENT DOCUMENTS

| | | | |
|---|---|---|---|
| 4,566,418 | 1/1986 | Yamamoto et al. . | |
| 5,109,819 | 5/1992 | Custer et al. . | |
| 5,243,854 | 9/1993 | Ishida . | |
| 5,255,653 | 10/1993 | Ironside et al. . | |
| 5,320,076 | 6/1994 | Reppich et al. . | |
| 5,370,094 | 12/1994 | Sorg et al. . | |
| 5,429,091 | 7/1995 | Huber et al. . | |
| 5,436,826 | 7/1995 | O'Flarity . | |
| 5,553,581 | 9/1996 | Hirabayashi et al. . | |
| 5,602,732 | 2/1997 | Nichols et al. . | |
| 5,619,967 | 4/1997 | Streib . | |
| 5,622,151 | 4/1997 | Lang . | |
| 5,623,905 | 4/1997 | Kau et al. . | |
| 5,654,888 | 8/1997 | Muller et al. . | |
| 5,875,760 * | 3/1999 | Bauer et al. | 123/399 |
| 6,148,795 * | 11/2000 | Gerhardt et al. | 123/399 |

* cited by examiner

*Primary Examiner*—Erick Solis
(74) *Attorney, Agent, or Firm*—Allan J. Lippa

(57) ABSTRACT

A system and method for controlling a powertrain using multiple position sensors for electronic airflow control include comparing values corresponding to position signals generated by each of the sensors to upper and lower thresholds to determine if each signal is within a first range, and comparing at least one pair of values corresponding to the signals to generate at least one difference value which is compared to a corresponding difference threshold.

22 Claims, 3 Drawing Sheets

ELECTRONIC AIRFLOW CONTROL

TECHNICAL FIELD

The present invention is directed to an electronic throttle control strategy.

BACKGROUND ART

Mechanical throttle control systems use airflow as the primary control parameter in controlling powertrain output. The airflow is controlled by a throttle valve in the intake which is mechanically linked to a throttle pedal. As such, many powertrain control parameters were traditionally based on, or indexed by, the throttle valve position.

Electronic airflow control systems, such as variable cam timing systems and electronic throttle control systems, replace the traditional mechanical throttle cable system with an "electronic linkage" provided by sensors and actuators in communication with an electronic controller. This increases the control authority of the electronic controller and allows the airflow to be controlled independently of the accelerator pedal position. As such, the throttle valve position is no longer necessarily indicative of the requested or desired powertrain output.

SUMMARY OF THE INVENTION

It is an object of the present invention to provide a system and method for control of an electronic throttle control system.

In carrying out the above object and other objects, advantages, and features of the present invention, a system and method for controlling a powertrain using electronic airflow control for an internal combustion engine including a plurality of position sensors include comparing values corresponding to signals generated by each of the plurality of sensors to at least one corresponding threshold to determine if each signal is within a predetermined range. An out-of-predetermined-range signal is generated for each sensor having at least one value which is outside of the predetermined range. The system and method also include comparing at least one pair of values corresponding to the signals to generate at least one difference value, comparing the difference value to a corresponding difference threshold, generating a difference exceeded signal if the difference value exceeds the difference threshold, controlling the powertrain based on the values corresponding to the signals generated by the plurality of sensors, the out-of-predetermined-range signal, and the difference exceeded. In a preferred embodiment, three redundant position sensors are provided for each of the accelerator pedal position and the throttle position.

The above advantages and other advantages, objects, and features of the present invention, will be readily apparent from the following detailed description of the best mode for carrying out the invention when taken in connection with the accompanying drawings.

BEST MODE(S) FOR CARRYING OUT THE INVENTION

Figure 1:
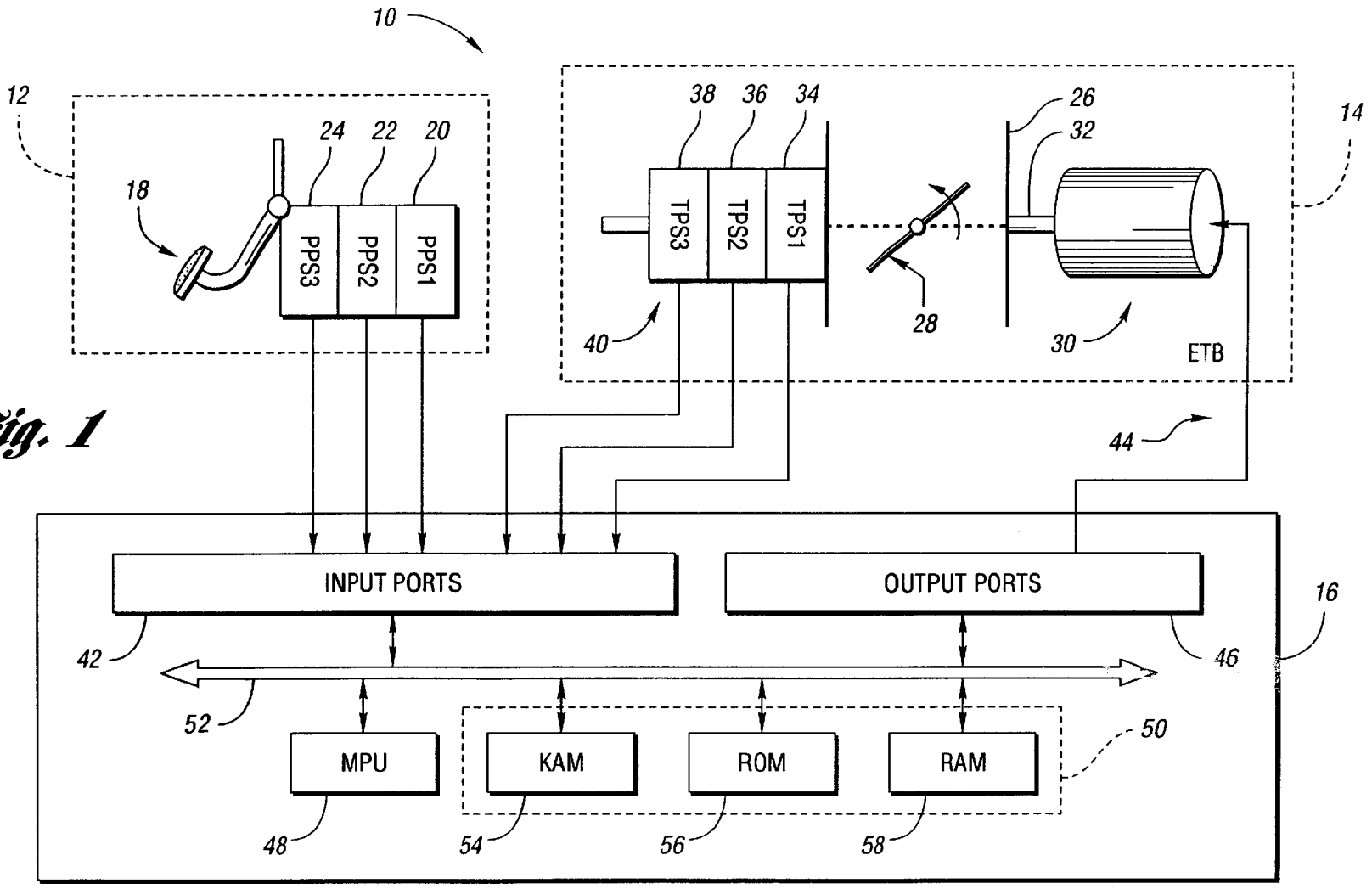
FIG. 1 is a block diagram illustrating a system and method for controlling a powertrain using redundant electronic airflow control sensors according to the present invention.

FIG. 1 provides a block diagram illustrating operation of a system or method for electronic airflow control.

System 10 includes an accelerator pedal assembly 12 and an electronic throttle body assembly 14 in communication with a controller 16. Accelerator pedal assembly 12 includes an accelerator pedal 18 which is manipulated by an operator to provide an indication of the driver demand or requested powertrain output. Redundant pedal position sensors (PPS) 20, 22, and 24 are used to generate signals indicative of the position of accelerator pedal 18. The signals generated by pedal position sensors 20, 22, and 24 are processed by processor 16, as explained in greater detail below.

Electronic throttle body assembly 14 includes a throttle body 26 positioned within the intake airflow path of an internal combustion engine (not shown). A throttle plate 28 is disposed within throttle body 26 to modify the airflow into the engine as is well known in the art. A motor and interface 30 is connected via a shaft 32 to throttle plate 28 to rotate throttle plate 28 to a commanded position or throttle angle. Throttle position sensors (TPS) 34, 36, and 38 provide signals indicative of the position of throttle plate 28 which are communicated to, and processed by, processor 16.

Processor 16 includes input ports 42 for receiving signals from various sensors, indicated generally by reference numeral 40. Input ports 42 may provide various signal processing functions including signal conditioning and open/short circuit detection and protection. Processor 16 receives and processes signals via input ports 42 and generates command or control signals which are communicated to various actuators, indicated generally by reference numeral 44, via output ports 46. Preferably, processor 16 is a microprocessor-based controller which includes a microprocessing unit (MPU) 48 in communication with various computer-readable media 50 via a control and/or data bus 52. Computer-readable media 50 may include various types of volatile and nonvolatile memory such as keep-alive memory (KAM) 54, read-only memory (ROM) 56, and random access memory (RAM) 58. These "functional" descriptions of the various types of volatile and nonvolatile storage may be implemented by any of a number of known physical devices including but not limited to EPROMS, EEPROMS, PROMS, flash memory, and the like. Computer-readable media 50 includes stored data representing instructions executable by microprocessor unit 48 to implement a method for controlling a vehicle using redundant position sensors according to the present invention.

In a preferred embodiment, accelerator pedal assembly 12 communicates with the vehicle or powertrain control module which functions as controller 16 to generate commands to control the position of throttle plate 28 within electronic throttle body 14. Of course, separate controllers or control modules may be provided to control electronic throttle body 14 and/or accelerator pedal assembly 12. Separate controllers or modules preferably communicate with a powertrain controller or vehicle controller, such as controller 16, without departing from the spirit or scope of the present invention.

Figure 2:
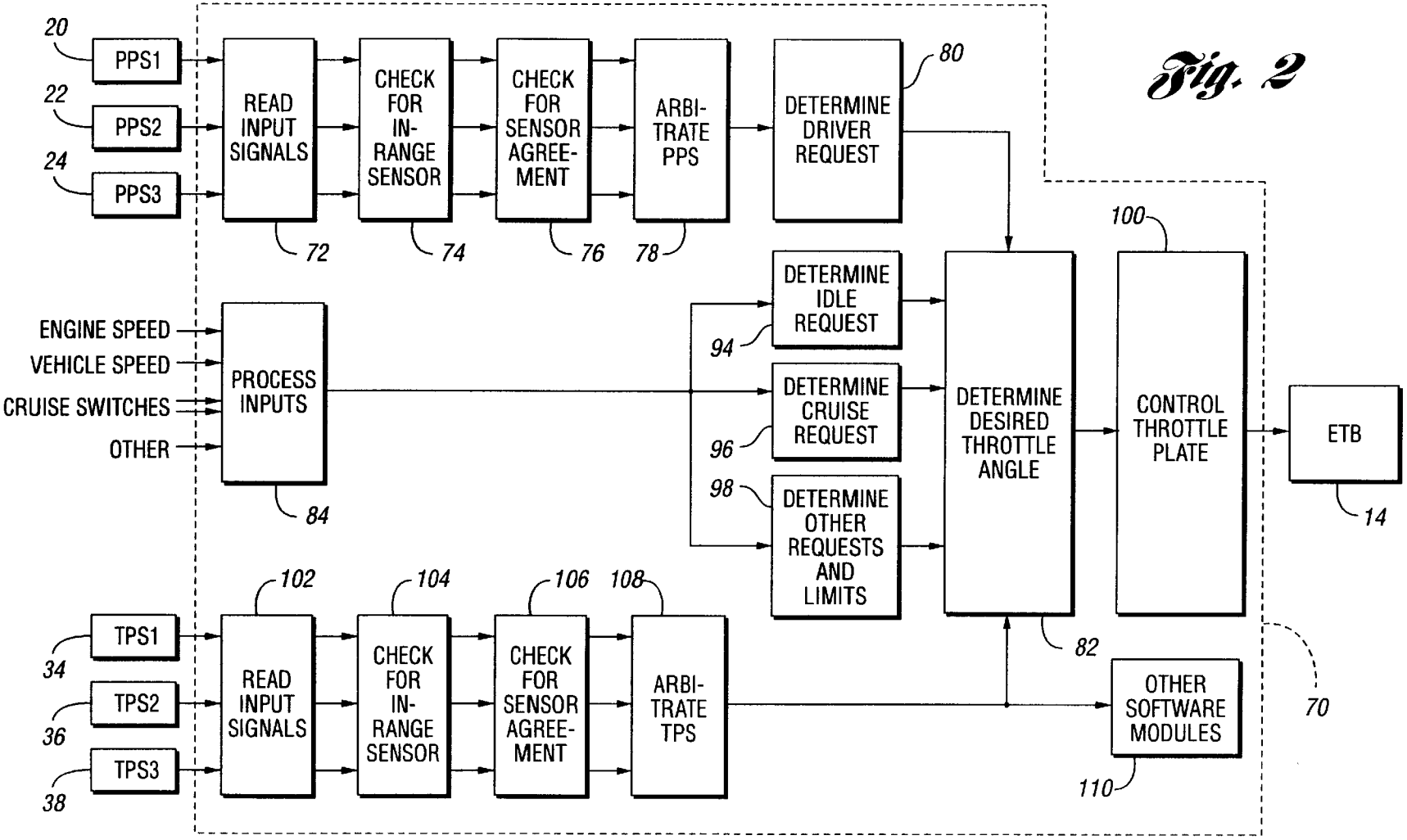
FIG. 2 is a block diagram illustrating a powertrain control strategy including redundant sensor arbitration according to the present invention.

Referring now to FIG. 2, a system block diagram illustrating redundant position sensor control according to the present invention is shown. Block 70 represents various functions which are preferably performed by software within the vehicle controller. Of course, these functions may be implemented by separate controllers as described above depending on the particular application. Pedal position sensors 20, 22, and 24 generate signals which are converted to a digital representation as represented by block 72. An in-range check for each sensor is performed to detect open/short circuits as represented by block 74. A check to determine sensor agreement is then performed as represented by block 76, and explained in greater detail below with reference to FIG. 3. The various digital representations of the accelerator pedal position sensors are arbitrated as represented by block 78 to determine the driver demand or request as represented by block 80. The driver request determined by block 80 is one of the inputs used to determine the desired throttle angle as represented by block 82.

Various other inputs are processed as represented by block 84. These inputs may include engine speed 86, vehicle speed 88, cruise control switches 90, and various other sensors used to detect the current operating conditions of the engine and/or vehicle. These inputs are used to determine the idle speed controller request as represented by block 94, the cruise control request as represented by block 96, and various other requests as represented by block 98. For example, block 98 may represent a traction assist request or engine speed limit request. Block 82 then determines a desired throttle angle opening based on the requesters 80, 94, 96, and 98. The desired throttle angle determined by block 82 is used to control throttle plate 28 as represented by block 100. Preferably, a feedback controller is implemented in software using the throttle position sensors 34, 36, and 38 to provide feedback as to the actual position of throttle plate 28.

The position signals generated by throttle position sensors 34, 36, and 38 are converted and/or filtered as represented by block 102. These signals are then examined to determine if they are in-range for the various sensors as represented by block 104. Block 106 represents a check to determine sensor agreement as explained in greater detail with reference to FIG. 3. The sensor signals, or values representative thereof, are arbitrated to determine a final throttle position signal or value as represented by block 108. This value may be provided to various other software modules as represented by block 110. The feedback controller provides an appropriate signal to control the throttle plate within electronic throttle body 14.

While the present invention is described with reference to electronic airflow control in an automotive powertrain, one of ordinary skill in the art will recognize that the present invention could be easily applied to various other control systems which require selection or generation of a control signal or parameter using multiple sensors.

Figure 3:
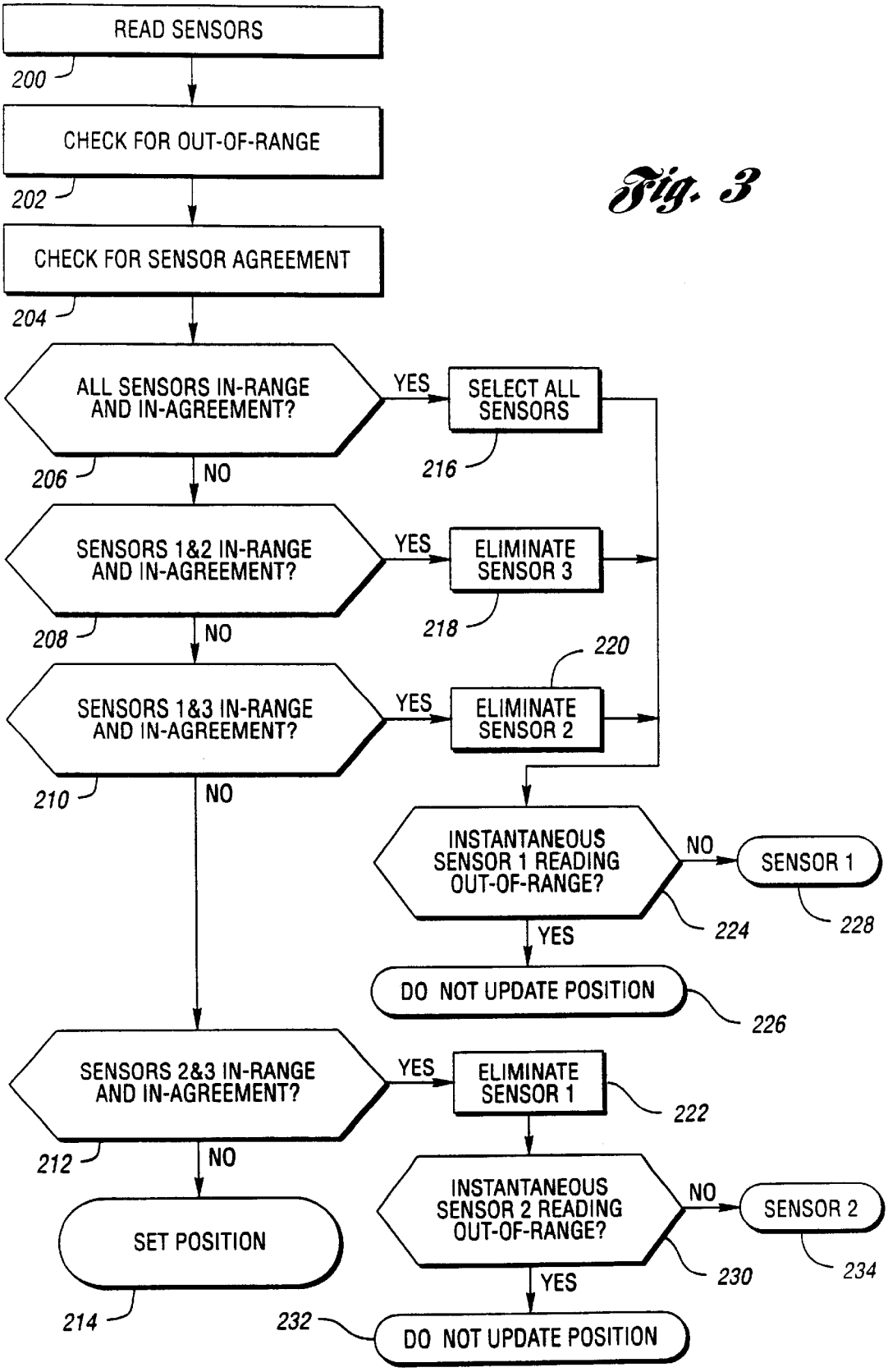
FIG. 3 is a flowchart illustrating control logic for implementing a system or method for electronic airflow control using redundant sensor arbitration according to the present invention.

Referring now to FIG. 3, a more detailed flowchart illustrating control logic of one embodiment, of a system or method according to the present invention is shown. As will be appreciated by one of ordinary skill in the art, the flowchart illustrated in FIG. 3 may represent any of a number of known processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages of the invention, but is provide for ease of illustration and description. Preferably, the control logic is implemented in software which is executed by a microprocessor-based controller. Of course, the control logic may be implemented in software, hardware, or a combination of software and hardware. As will be appreciated by those of skill in the art, the steps or functions illustrated are preferably repeated at predetermined time intervals which may vary based on the particular nature of the step or function. Many powertrain controllers have multiple time-based interrupts for handling various tasks depending upon the timeliness of the information or control required, while also servicing event-based interrupts and associated control functions.

The position sensors are read as represented by block 200 of FIG. 3. This step may include appropriate filtering and conversion of the sensor signals into corresponding values indicative of the position of a particular control device, such as the throttle valve or the accelerator pedal. In a preferred embodiment of the present invention, the throttle valve position sensors and the accelerator pedal position sensors generate signals which are converted into counts for processing by the controller. As illustrated and described with reference to FIGS. 1 and 2, the present invention preferably includes at least three position sensors for each control device. As illustrated in FIG. 3, the control strategy arbitrates between the sensors to determine which sensor position value should be used to control the powertrain.

Each sensor signal or corresponding value is compared to at least one threshold to determine whether it is as represented by block 202. In a preferred embodiment, block 202 represents comparison of each value to a lower threshold and an upper threshold to determine if the value is within the appropriate range. Different ranges could be provided for the accelerator pedal sensors as compared to the throttle valve position sensors. If any of the position sensors have values which are outside of the range for a predetermined period of time, a corresponding out-of-predetermined-range flag is generated for that sensor.

The sensor signals (or corresponding values) are also checked for agreement with one another, as represented by block 204. Preferably, each pair of values is compared to generate a corresponding difference value, i.e., each sensor is compared to every other sensor and a difference value corresponding to the absolute value between the sensor values is generated. The difference values are compared to a difference value threshold to determine whether a corresponding difference-exceeded flag should be generated. If the difference value is sufficiently large for a predetermined period of time, the difference-exceeded flag is set. The difference values are also used by the subsequent arbitration strategy.

The remaining elements of FIG. 3 illustrate the strategy which determines which sensor value to use. If all of the sensors are within the acceptable range, and have values within the tolerance by the difference threshold as represented by block 206, then no flags are set as represented by block 216. The tests performed by blocks 208, 210, and 212 are used to eliminate a particular sensor from use. In the preferred embodiment, a sensor can be eliminated by the difference exceeding the difference threshold for any sensor as compared to the two other sensors. As such, the eliminated sensor can be identified as indicated by blocks 218, 220, and 222.

Once the arbitration strategy determines which sensor or sensors to eliminate from consideration, if any, as represented by blocks 216–222, it then determines which sensor position information to use in controlling the powertrain. Preferably, the first sensor is used if it has not been eliminated and either the second or third sensor has also not been eliminated. Block 224 represents another range check to determine whether the instantaneous sensor reading is within a selected range. If the instantaneous sensor value is not within the range but a condition flag has not yet been set, the "out-of-predetermined-range" position value is not used in controlling the powertrain, as represented by block 226. Rather, the most recent value for that sensor which is within the range is used. However, if the sensor is within the range and a condition flag is not set, then the first sensor value is used as represented by block 228.

If the first sensor has been eliminated, as represented by block 222, and both the second and third sensors have not been eliminated, block 230 performs an additional range check, preferably on the second sensor value. Similar to the test performed by block 224, block 230 determines whether the instantaneous value for the second sensor is within the range. If the second sensor value is outside of the range but the condition flag has not yet been set, the sensor position is not updated as indicated by block 232. Once the sensor value falls within the range, the second sensor value is used to control the powertrain as represented by block 234.

While the best mode for carrying out the invention has been described in detail, those familiar with the art to which this invention relates will recognize various alternative designs and embodiments for practicing the invention as defined by the following claims.

What is claimed is:

1. A method for controlling a vehicle having a plurality of position sensors, the method comprising:

comparing values corresponding to signals generated by each of the plurality of sensors to at least one corresponding threshold to determine if each signal is within a first range;

generating an out-of-predetermined-range signal for each sensor having at least one value which is outside of the first range;

comparing at least one pair of values corresponding to the signals to generate at least one difference value;

comparing the difference value to a corresponding difference threshold;

generating a difference signal if the difference value exceeds the difference threshold; and controlling the vehicle using a predetermined default value if a signal has been generated by either of the generating steps for at least two of the plurality of sensors.

2. The method of claim 1 wherein the step of generating an out-of-predetermined-range signal comprises generating an out-of-predetermined-range signal only after a predetermined elapsed time during which at least one value is outside of the first range.

3. The method of claim 2 wherein the step of controlling comprises maintaining a previously determined position value when at least one value is outside of the first range but before the predetermined time has elapsed.

4. The method of claim 1 wherein the plurality of position sensors includes first, second, and third position sensors, wherein the step of comparing at least one pair includes comparing the first and second, second and third, and first and third sensor values and wherein the step of generating a difference signal comprises generating a difference signal for the first sensor when the difference between the first and second sensor values, and the difference between the first and third sensor values, both exceed the difference threshold.

5. The method of claim 4 wherein the step of controlling the powertrain comprises controlling the powertrain based on the second sensor when the difference signal exists.

6. The method of claim 4 wherein the step of controlling the powertrain comprises controlling the powertrain based on the second and third sensors when the difference signal exists.

7. A system for controlling a vehicle including an internal combustion engine having at least one control device for controlling output of the powertrain, the system comprising:

first, second, and third position sensors for providing corresponding signals indicative of position of a control device for controlling output of the powertrain;

a controller in communication with the position sensors, the controller converting the signals to corresponding first, second, and third values, comparing each value to a lower range threshold and an upper range threshold, generating a range signal for each sensor having a value below the lower range threshold or above the upper range threshold, generating difference values corresponding to differences between the first and second, second and third, and first and third values, comparing the difference values to a difference value threshold, generating a difference signal for each sensor which exceeds the difference value threshold for two comparisons, and selecting one of the first, second, and third values for use in controlling the powertrain.

8. The system of claim 7 wherein the first, second, and third position sensors comprise throttle valve position sensors for generating a signal indicative of angular position of the throttle valve within the intake passage.

9. The system of claim 8 wherein the throttle valve position sensors are substantially identical such that any one of the sensors may be used to provide a throttle valve position signal used to control the powertrain.

10. The system of claim 7 wherein the position sensors comprise accelerator pedal position sensors which generate corresponding signals indicative of position of the accelerator pedal.

11. The system of claim 10 wherein the accelerator pedal position sensors are substantially identical such that any one of the sensors may be used to provide an accelerator pedal position signal used to control the powertrain.

12. The system of claim 7 further comprising:

fourth, fifth, and sixth position sensors for generating corresponding signals indicative of a second control device used to control output of the powertrain, the fourth, fifth, and sixth position sensors being in communication with the controller;

wherein the controller compares values corresponding to the fourth, fifth, and sixth sensor signals to a second lower range threshold and a second upper range threshold and generates a second range signal for each sensor having a value below the second lower range threshold or above the second upper range threshold.

13. The system of claim 12 wherein the fourth, fifth, and sixth position sensors comprise accelerator pedal position sensors and wherein the first, second, and third position sensors comprise throttle valve position sensors.

14. A computer readable storage medium having stored data representing instructions executable by a computer to control an internal combustion engine based on position signals received from a plurality of position sensors, the computer readable storage medium comprising:

instructions for comparing values corresponding to the position signals generated by each of the plurality of sensors to at least one corresponding threshold to determine if each signal is within a first range;

instructions for generating a range signal for each sensor having at least one value which is outside of the first range;

instructions for comparing at least one pair of values corresponding to the position signals to generate at least one difference value;

instructions for comparing the difference value to a corresponding difference threshold;

instructions for generating a difference signal if the difference value exceeds the difference threshold; and instructions for controlling the powertrain using a predetermined default value if a signal has been generated by either of the generating steps.

15. The computer readable storage medium of claim 14 wherein the instructions for generating a range signal include instructions for generating a range signal only after a predetermined elapsed time during which at least one value is outside of the first range.

16. The computer readable storage medium of claim 15 wherein the instructions for controlling the powertrain include instructions for maintaining a previously determined position value when at least one value is outside of the first range but before the predetermined time has elapsed.

17. A method for controlling a vehicle having a plurality of position sensors, the method comprising:

comparing values corresponding to signals generated by each of the plurality of sensors to at least one corresponding threshold to determine if each signal is within a first range;

generating an out-of-predetermined-range signal for each sensor having at least one value which is outside of the first range for a predetermined time;

comparing at least one pair of values corresponding to the signals to generate at least one difference value;

comparing the difference value to a corresponding difference threshold;

generating a difference signal if the difference value exceeds the difference threshold;

maintaining a previously determined position value when at least one value is outside of the first range but before the predetermined time has elapsed;

controlling the vehicle using the previously determined position value.

18. The method of claim 17 further comprising controlling the vehicle using a predetermined default value if a signal has been generated by either of the generating steps for at least two of the plurality of sensors.

19. A method for controlling a vehicle having first, second, and third position sensors, the method comprising:

comparing values corresponding to signals generated by each of the first, second, and third sensors to at least one corresponding threshold to determine if each signal is within a first range;

generating an out-of-predetermined-range signal for each sensor having at least one value which is outside of the first range;

comparing at least one pair of values corresponding to the signals to generate at least one difference value;

comparing the difference value to a corresponding difference threshold;

generating a difference signal if the difference value exceeds the difference threshold; and selecting not more than one of the first, second, and third values for controlling the vehicle based on corresponding signals generated by the first, second, and third sensors, the out-of-predetermined-range signal, and the difference signal.

20. The method of claim 19 further comprising:

selecting a predetermined default value for controlling the vehicle if a signal has been generated by either of the generating steps for at least two of the first, second, and third sensors.

21. The method of claim 19 wherein the step of generating an out-of-predetermined-range signal comprises generating an out-of-predetermined-range signal only after a predetermined elapsed time during which at least one value is outside of the first range.

22. The method of claim 19 further comprising:

selecting a previously determined position value for controlling the vehicle when at least one value is outside of the first range.

* * * * *